US009303444B1

(12) United States Patent
Choi

(10) Patent No.: US 9,303,444 B1
(45) Date of Patent: Apr. 5, 2016

(54) DOOR RAIL SYSTEM

(71) Applicant: Kevin Byong Sun Choi, Buena Park, CA (US)

(72) Inventor: Kevin Byong Sun Choi, Buena Park, CA (US)

( * ) Notice: Subject to any disclaimer, the term of this patent is extended or adjusted under 35 U.S.C. 154(b) by 0 days.

(21) Appl. No.: 14/631,657

(22) Filed: Feb. 25, 2015

(51) Int. Cl.

| | |
|---|---|
| ***E04C 2/38*** | (2006.01) |
| ***E06B 3/54*** | (2006.01) |
| ***E06B 5/00*** | (2006.01) |
| ***E06B 7/28*** | (2006.01) |

(52) U.S. Cl.
CPC ..... *E06B 3/549* (2013.01); *E06B 3/5454* (2013.01); *E06B 5/00* (2013.01); *E06B 7/28* (2013.01)

(58) Field of Classification Search
CPC ..... E06B 3/549; E06B 5/00; E06B 3/5864; E06B 3/5871; E06B 3/585; E06B 3/5857; E06B 7/28
See application file for complete search history.

(56) References Cited

U.S. PATENT DOCUMENTS

| | | | | |
|---|---|---|---|---|
| 1,893,713 | A * | 1/1933 | Murnane | 52/204.57 |
| 3,760,543 | A * | 9/1973 | McAllister | 52/204.591 |
| 3,903,669 | A * | 9/1975 | Pease et al. | 52/455 |
| 4,655,025 | A * | 4/1987 | Marinoni | 52/771 |
| 4,754,592 | A * | 7/1988 | Moench et al. | 52/786.13 |
| 4,920,718 | A * | 5/1990 | Artwick et al. | 52/476 |
| 6,434,905 | B1 * | 8/2002 | Sprague | 52/474 |
| 7,255,511 | B2 * | 8/2007 | Dolan | 403/403 |
| 8,925,258 | B1 * | 1/2015 | Header et al. | 52/126.4 |
| 2011/0239560 | A1 * | 10/2011 | Landeros | 52/204.61 |

* cited by examiner

*Primary Examiner* — Katherine Mitchell
*Assistant Examiner* — Abe Massad
(74) *Attorney, Agent, or Firm* — East West Law Group; Heedong Chae

(57) ABSTRACT

A door rail system for mounting a pane includes a clamp housing having a tapered projection and a pair of clamps having a recess. A screw fastens the clamps together from a side of the clamp housing so that the recesses and tapered projection are configured to form a secure dovetail joint for holding a pane. The recesses (and clamps) are symmetrical and the tapered projection is at the center so that a pane can be securely held at the center without being tilted. The door rail system includes an accessory channel and first and second mounting members. The first and second mounting members are slidably attached to each other by a sliding dovetail joint so that each mounting member can slide against the other mounting member.

19 Claims, 8 Drawing Sheets

DOOR RAIL SYSTEM

FIELD OF THE INVENTION

The present invention relates to a door rail system for holding a pane such as plate glass panes or panels and, more particularly, to a door rail system having a pair of clamps having recesses and a clamp housing having a tapered projection. The recesses and tapered projection are configured to form a dovetail joint when the clamps are clamped together.

BACKGROUND OF THE INVENTION

Door rail systems are widely used to hold plate glass panes or panels, including transparent, translucent or opaque panels (hereinafter called "pane") and such systems employs support rails or similar frames which attach to the top or bottom edges of the pane.

FIG. 1 shows a prior art rail system 10 having a male rail section and a female rail section. The male and female sections are clamped together by a screw to hold a pane 90 and to form an accessory channel 70. The accessory channel 70 is necessary to mount a door closure member, locking hardware, pivots, hinges or other mounting structure required to mount the rail system 10 in a door or other frame. However, the accessory channel 70 is defined by two pieces of male and female sections and thus, to dissemble the pane, the accessory channel 70 needs to be dissembled as well.

To overcome this disadvantage, another rail system 10 was developed as in FIG. 2, having first and second clamps and a housing 20. The clamps are clamped together by rotating a screw from a bottom to hold a pane 90. However, rotating a screw from a bottom is inconvenient and the rail system 10 has to be dissembled from a door or other frame before dissembling the pane 90.

Besides, conventional door rail systems requires careful work of mounting such system to a door. Once the door rail system is mounted onto a door, its location cannot be adjusted and to adjust, it has to be dissembled and re-mounted. However, slight discrepancy or error is very common and accordingly re-work is common.

Therefore, to solve the above problems, there is a need for a door rail system having a pair of clamps having recesses, a clamp housing having a tapered projection, and a minute location adjusting means. This invention is directed to solve these problems and satisfy the long-felt need.

SUMMARY OF THE INVENTION

The present invention contrives to solve the disadvantages of the prior art. The present invention provides a door rail system having a pair of clamps having recesses and a clamp housing having a tapered projection.

The object of the present invention is to provide a door rail system for mounting a pane, which includes a longitudinally extending clamp housing, having a tapered projection; a first longitudinally extending clamp, having a first recess; a second longitudinally extending clamp, having a second recess. An adjustable fastening means fastens the first and second clamps to the tapered projection from a side of the clamp housing.

Another object of the present invention is to provide a door rail system for mounting a pane, which includes a clamp housing having a tapered projection and a pair of clamps having a recess. A screw fastens the clamps together from a side of the clamp housing so that the recesses and tapered projection are configured to form a secure dovetail joint for holding a pane. The recesses (and clamps) are symmetrical and the tapered projection is at the center so that a pane can be securely held at the center without being tilted.

Still another object of the present invention is to provide a door rail system for mounting a pane, which includes an accessory channel and first and second mounting members. The first and second mounting members are slidably attached to each other by a sliding dovetail joint so that each mounting member can slide against the other mounting member.

The advantages of the present invention are: (1) the door rail system has a clamp housing having a tapered projection and a pair of claims having symmetrical recesses for securely holding a pane at a center without being tilted; (2) the adjustable fastening means such as a screw is on a side of the clamp housing and thus the assembly work is easier and more convenient and the door rail system does not have to be dissembled from a door to dissemble the pane; (3) a pair of mounting members slidably attached to each other by a sliding dovetail joint are secured in the accessory joint, and thus minute adjustment of the door rail system with respect to a door is possible; and (4) the door rail system of the present invention has a slidably attachable side cover(s) and such side cover can provide aesthetic appearance.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Reference will now be made in detail to the preferred embodiments of the present invention, examples of which are illustrated in the accompanying drawings, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

Figure 1:
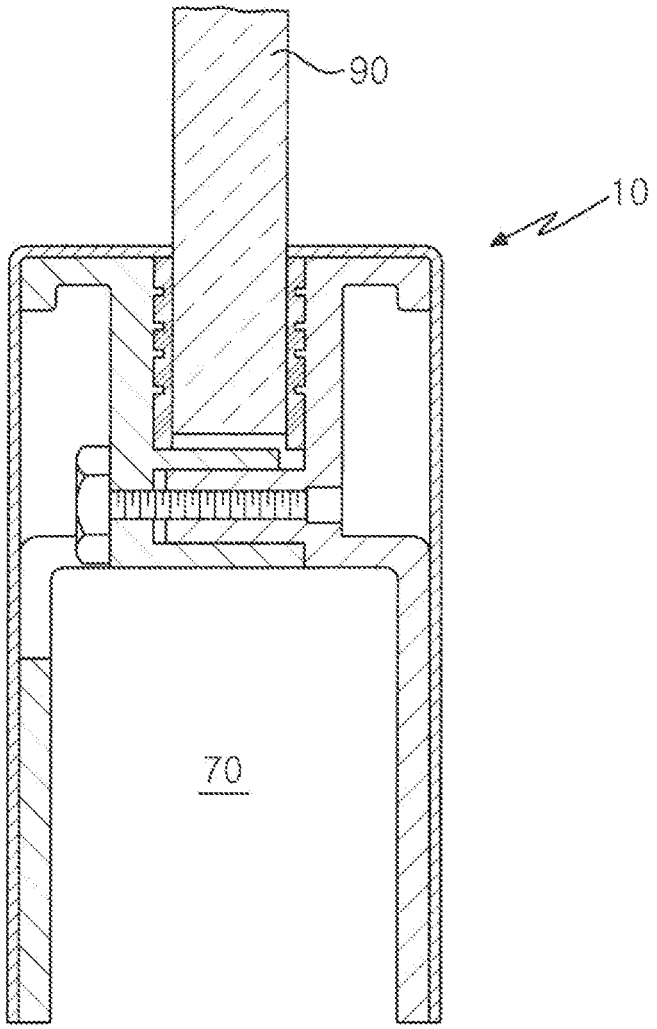
FIG. 1 PRIOR ART
FIG. 1 shows a cross-sectional view of a conventional door rail system.
Figure 2:
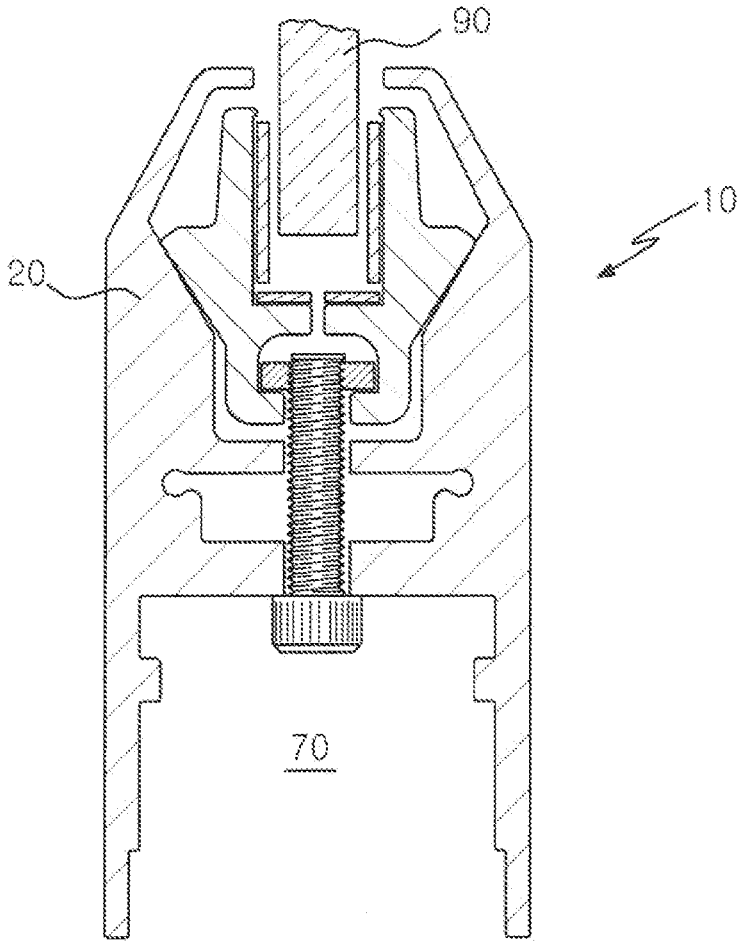
FIG.2 PRIOR ART
FIG. 2 shows a cross-sectional view of another conventional door rail system.
Figure 3:
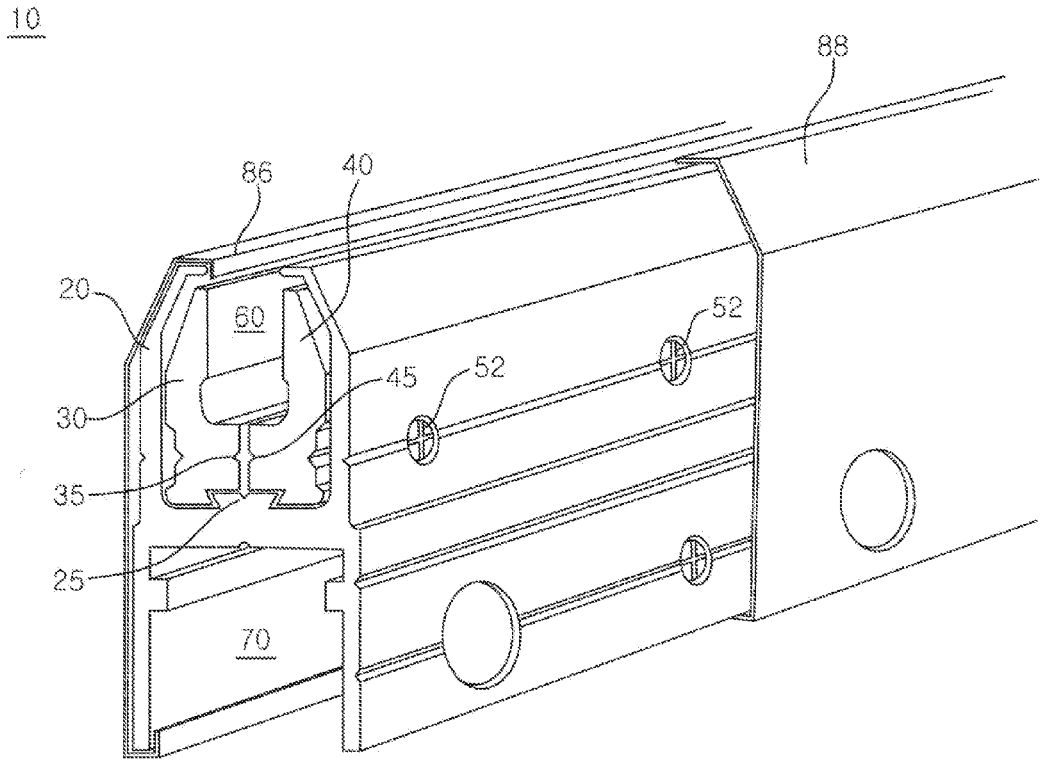
FIG. 3 shows a perspective view of a door rail system according to one embodiment of the present invention.
Figure 4:
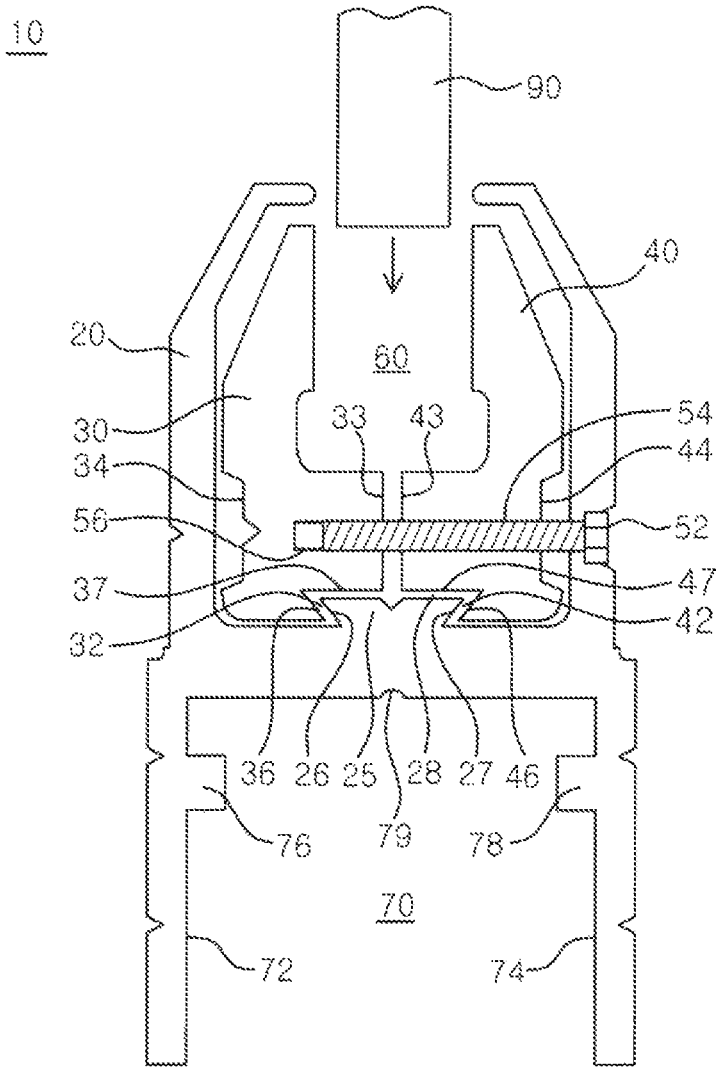
FIG. 4 shows a cross-sectional view of the door rail system according to one embodiment of the present invention.

FIGS. 3 and 4 show a perspective view and a cross-sectional view of a door rail system 10 according to one embodiment of the present invention.

The door rail system 10 for mounting a pane 90 comprises: a longitudinally extending clamp housing 20, having a tapered projection 25; a first longitudinally extending clamp 30, having a first recess 32; and a second longitudinally extending clamp 40, having a second recess 42. The door rail system 10 further includes an adjustable fastening means 52, 54, and 56 for fastening the first and second clamps 30 and 40 to the tapered projection 25; and a pane channel 60 defined by the first and second clamps 30 and 40 for receiving an edge of the pane 90. The tapered projection 25 is configured to interlock with the first and second recesses 32 and 42 when the first and second clamps 30 and 40 are clamped together by the adjustable fastening means 52, 54 and 56. Preferably, the first and second recesses 32 and 42 are symmetrical and the first and second clamps 30 and 40 may be symmetrical as well. The tapered projection 25 is located at the center as shown in FIG. 4 for securely holding the pane 90 at the center vertically without being tilted.

The adjustable fastening means comprises a screw 52, a through hole 54 and a threaded hole 56. The through hole 54 is configured so that the screw 52 can pass there-through and the threaded hole 56 is configured to be engaged with the screw 52 for clamping the first and second clamps 30 and 40 together to securely hold the pane 90.

The first clamp 30 comprises a first inner wall 33 and a first outer wall 34, and the second clamp 40 comprises a second inner wall 43 and a second outer wall 44 as shown in FIG. 4.

The through hole 54 may be formed on the second clamp 40 and the threaded hole 56 may be formed on the first clamp 30 as shown in FIG. 4. The screw 52 advances through the second outer wall 44 of the second clamp 40 and the through hole 54 of the second clamp 40 and then, the screw 52 is engaged with the threaded hole 56 of the first clamp 30.

Alternatively, the through hole 54 may be formed on the first clamp 30 and the threaded hole 56 may be formed on the second clamp 40. The screw 52 advances through the first outer wall 34 of the first clamp 30 and the through hole 54 of the first clamp 30 and then, the screw 52 is engaged with the threaded hole 56 of the second clamp 40.

A first groove 35 may be formed on the first inner wall 33 and a second groove 45 may be formed on the second inner wall 43, and the first and second grooves 35 and 45 may form an opening when the first and second clamps 30 and 40 are clamped together as shown in FIG. 3. The grooves 35 and 45 may be formed passing through the through holes 54 or threaded holes 56 on the inner walls 33 and 43.

Figure 5:
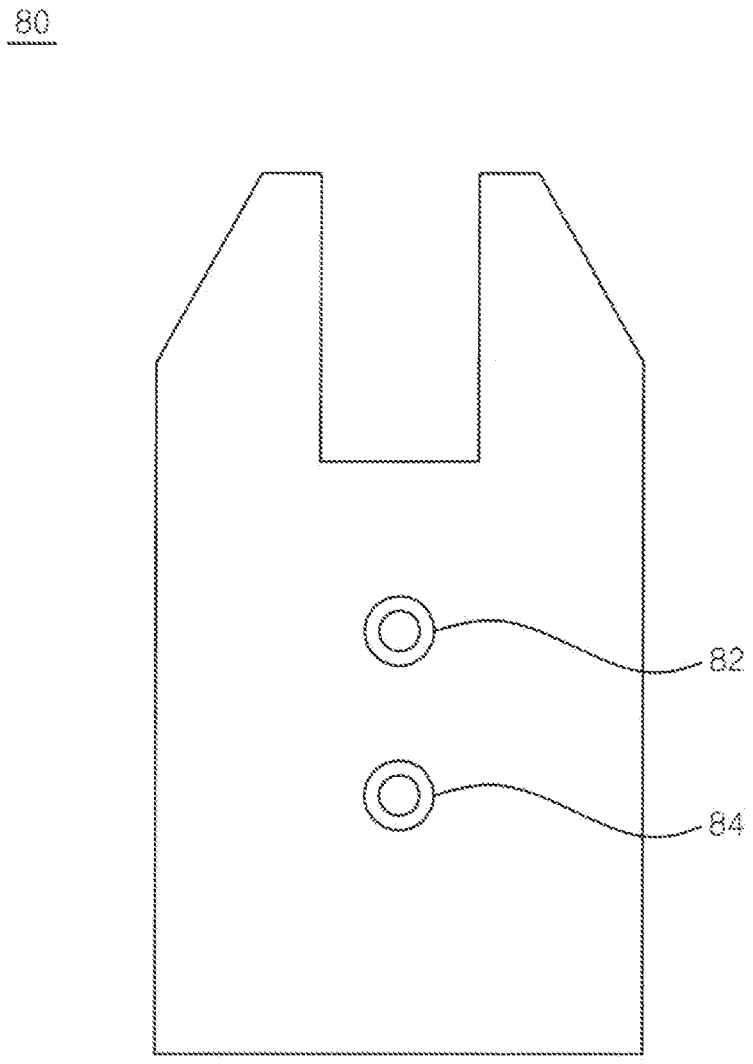
FIG. 5 shows a front view of an end cap of the door rail system according to the present invention.

FIG. 5 shows a front view of an end cap 80. The door rail system 40 may further comprises an end cap 80 secured at an end of the clamp housing 20 by an end cap fastening means 82 and 84. The end cap fastening means may be a screw 82 which may be engaged with threads of the opening formed by the grooves 35. Another screw 84 may be engaged with threads of another opening formed on the base surface of the accessory channel 70.

The end cap fastening means may comprise an end cap screw 82 which is configured to be engaged with the first and second grooves 35 and 45. Ends of the first and second grooves 35 and 45 may be threaded.

The tapered projection 25 may comprise a first tapered wall 26, a second tapered wall 27 and a wide end surface 28 to form a dovetail shape. For conforming to the dovetail shape of the tapered projection 25, the first recess 32 comprises a first inclined wall 36 and a first flat surface 37 and the second recess 42 comprises a second inclined wall 46 and a second flat surface 47.

The first inclined wall 36 is located adjacent to the first tapered wall 26 and configured to be approximately parallel to the first tapered wall 26 when the first and second clamps 30 and 40 are clamped together. In addition, the second inclined wall 46 is located adjacent to the second tapered wall 27 and configured to be approximately parallel to the second tapered wall 27 when the first and second clamps 30 and 40 are clamped together. Furthermore, the first and second flat surfaces 37 and 47 are located adjacent to the wide end surface 28 and configured to be approximately parallel to the wide end surface 28 when the first and second clamps 30 and 40 are clamped together.

For securely holding the pane 90 vertically, when the first and second clamps 30 and 40 are clamped together by the screw 52, the first inclined wall 36 is in contact with the first tapered wall 26, the second inclined wall 46 is in contact with the second tapered wall 27, and the first and second flat surfaces 37 and 47 are in contact with the wide end surface 28.

As in FIG. 3, the door rail system 10 may further include a first slide cover 86 for covering a first exterior side surface of the clamp housing 20 and a second slide cover 88 for covering a second exterior side surface of the clamp housing 20. The slide covers 86 and 88 are slidably engaged with the clamp housing 20.

Figure 6:
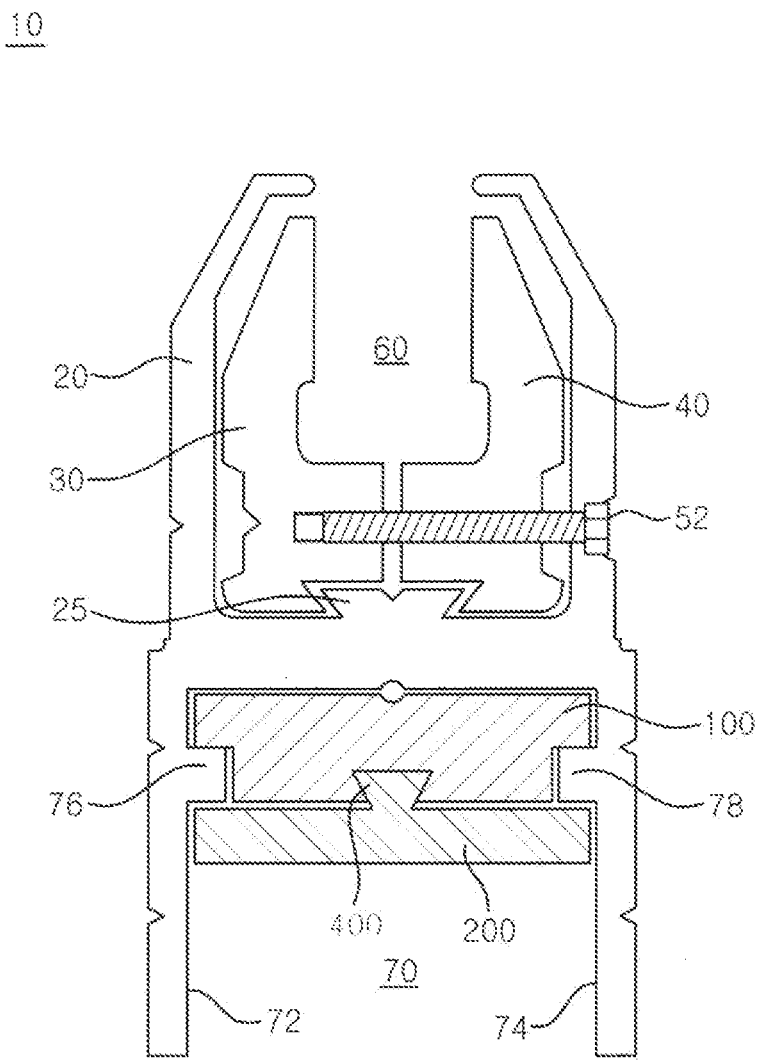
FIG. 6 shows a cross-sectional view of the door rail system having first and second mounting members according to another embodiment of the present invention.
Figure 7:
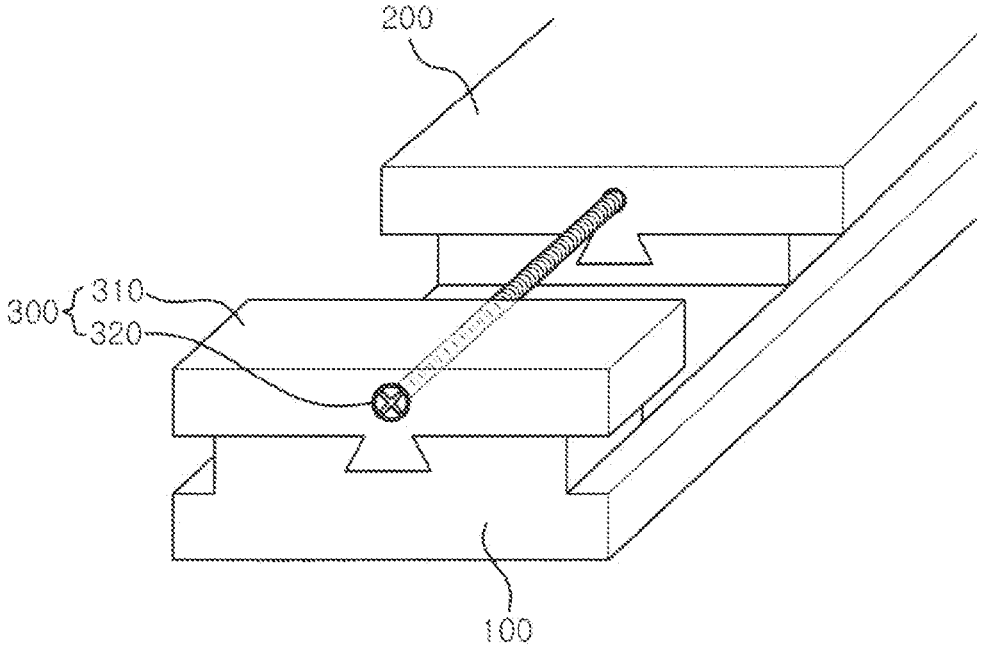
FIG. 7 shows a partial perspective view of the first and second mounting members according to the present invention.
Figure 8:
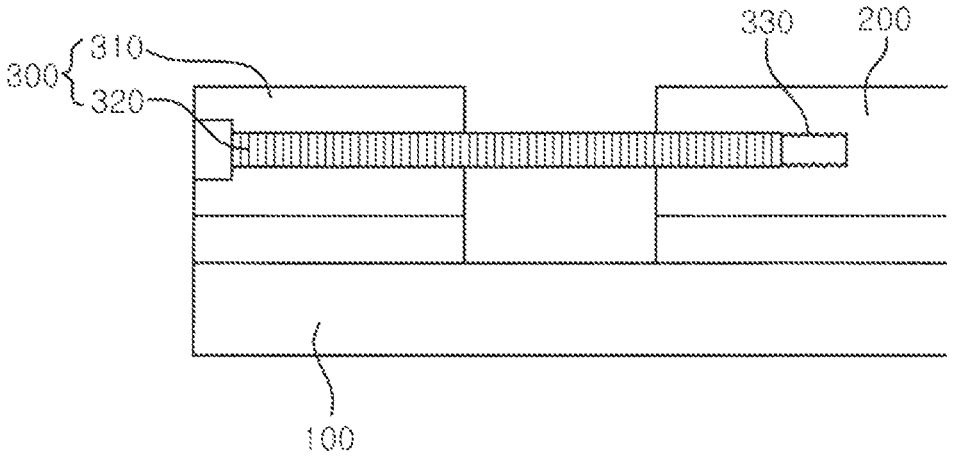
FIG. 8 shows a partial cross-sectional view of the first and second mounting members according to the present invention.

FIG. 6 shows a cross-sectional view of the door rail system having first and second mounting members 100 and 200 according to another embodiment of the present invention. FIGS. 7 and 8 respectively show a partial perspective view and a partial cross-sectional view of the first and second mounting members 100 and 200.

The door rail system 10 may further include an accessory channel 70 and the accessory channel 70 may include a first inner wall 72, a second inner wall 74 and a base surface. The base surface connects the first and second inner walls 72 and 74.

A first protrusion 76 may be formed on the first inner wall 72 of the accessory channel 70 and a second protrusion 78 may be formed on the second inner wall 74 of the accessory channel 70. The first and second protrusions 76 and 78 are longitudinally extending.

The door rail system 10 may further comprises a first mounting member 100 which is configured to be slidably inserted into and engaged with the accessory channel 70 and secured therein by the first and second protrusions 76 and 78.

The door rail system 10 may further comprise a second mounting member 200 which is configured to be slidably engaged with the first mounting member 100 by a sliding dovetail joint 400 so that the second mounting member 200 can slide against the first mounting member 100.

The door rail system 10 may further include a location adjusting means 300 for slidably adjusting a location of the second mounting member 200 with respect to the first member 100 as shown in FIGS. 7 and 8.

The location adjusting means 300 comprises an anchor 310 and a screw 320 wherein the anchor 310 is fixedly attached to the first mounting member 100. A through hole is formed on the anchor 310 so that the screw 320 can pass through and a threaded hole 330 is formed on the second mounting member 200. The screw 320 passes through the through hole and is engaged with the threaded hole 330. Accordingly, the location adjusting means 300 adjusts the location of the second mounting member by rotating the screw 320. This construction by the mounting members 100 and 200 is very useful for delicate or minute adjustment of the location of the second mounting member 200. After attaching the door rail system 10 to a door, there may be some error in correct location of the door rail system 10 and the error can be corrected by adjusting the location of the second mounting member 200. The door rail system 10 does not have to be dissembled and re-assembled to correct the error.

The structure of the mounting members 100 and 200 may be independent or separate of the structure by the tapered projection 25 and the clamps 30 and 40. Thus, in one embodiment of the present invention, the door rail system 10 for mounting a pane may comprise an accessory channel 70 having a first inner wall 72, a second inner wall 74 and a base surface wherein a first protrusion 76 is formed on the first inner wall 72 and a second protrusion 78 is formed on the second inner wall 74. The door rail system 10 may further comprise a first mounting member 100, which is configured to be slidably inserted into and engaged with the accessory channel 70, and a second mounting member 200 which is configured to be slidably engaged with the first mounting member 100 by a sliding dovetail joint 400 so that the second mounting member 200 can slide against the first mounting member 100. The door rail system 10 further includes a location adjusting means 300 for slidably adjusting a location of the second mounting member 200 with respect to the first member 100. The first mounting member 100 is secured in the accessory channel 70 by the first and second protrusions 76 and 78.

The location adjusting means 300 comprises an anchor 310 and a screw 320 wherein the anchor 310 is fixedly attached to the first mounting member 100. A through hole is formed on the anchor 310 and a threaded hole 330 is formed on the second mounting member 200 such that the screw 320 can pass through the through hole and be engaged with the threaded hole 330. The location adjusting means 300 adjusts the location of the second mounting member by rotating the screw 320.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A door rail system for mounting a pane, comprising:

a longitudinally extending clamp housing, having a tapered projection;

a first longitudinally extending clamp, having a first recess;

a second longitudinally extending clamp, having a second recess;

an adjustable fastening means for fastening the first and second clamps to the tapered projection; and a pane channel defined by the first and second clamps for receiving an edge of the pane, wherein the tapered projection is configured to interlock with the first and second recesses when the first and second clamps are clamped together by the adjustable fastening means, and wherein when the first and second clamps are clamped together, the first and second recesses are symmetrical with respect to the tapered projection, the tapered projection is positioned at a center point between the first and second recesses, and the pane is placed along the center point between the first and second recesses.

2. The door rail system of claim 1, wherein the adjustable fastening means comprises a screw, a through hole and a threaded hole, wherein the through hole is configured so that the screw can pass there-through, wherein the threaded hole is configured to be engaged with the screw for clamping the first and second clamps together to securely hold the pane.

3. The door rail system of claim 2, wherein the first clamp comprises a first inner wall and a first outer wall, and wherein the second clamp comprises a second inner wall and a second outer wall.

4. The door rail system of claim 3, wherein the through hole is formed on the second clamp and the threaded hole is formed on the first clamp, wherein the screw advances through the second outer wall of the second clamp and the through hole of the second clamp and then, the screw is engaged with the threaded hole of the first clamp.

5. The door rail system of claim 3, wherein the through hole is formed on the first clamp and the threaded hole is formed on the second clamp, wherein the screw advances through the first outer wall of the first clamp and the through hole of the first clamp and then, the screw is engaged with the threaded hole of the second clamp.

6. The door rail system of claim 3, wherein a first groove is formed on the first inner wall and a second groove is formed on the second inner wall, wherein the first and second grooves form an opening when the first and second clamps are clamped together.

7. The door rail system of claim 6, further comprising an end cap secured at an end of the clamp housing by an end cap fastening means.

8. The door rail system of claim 7, wherein the end cap fastening means comprises an end cap screw which is configured to be engaged with the first and second grooves.

9. The door rail system of claim 1, wherein the tapered projection comprises a first tapered wall, a second tapered wall and a wide end surface, wherein the first recess comprises a first inclined wall and a first flat surface, wherein the second recess comprises a second inclined wall and a second flat surface, wherein the first inclined wall is located adjacent to the first tapered wall and configured to be approximately parallel to the first tapered wall when the first and second clamps are clamped together, wherein the second inclined wall is located adjacent to the second tapered wall and configured to be approximately parallel to the second tapered wall when the first and second clamps are clamped together, wherein the first and second flat surfaces are located adjacent to the wide end surface and configured to be approximately parallel to the wide end surface when the first and second clamps are clamped together.

10. The door rail system of claim 9, wherein when the first and second clamps are clamped together, the first inclined wall is in contact with the first tapered wall, the second inclined wall is in contact with the second tapered wall, and the first and second flat surfaces are in contact with the wide end surface.

11. The door rail system of claim 1, further comprising a first slide cover for covering a first exterior side surface of the clamp housing.

12. The door rail system of claim 11, further comprising a second slide cover for covering a second exterior side surface of the clamp housing.

13. The door rail system of claim 1, further comprising an accessory channel wherein the accessory channel comprises a first inner wall, a second inner wall and a base surface.

14. The door rail system of claim 13, wherein a first protrusion is formed on the first inner wall of the accessory channel and a second protrusion is formed on the second inner wall of the accessory channel, wherein the first and second protrusions are longitudinally extending.

15. The door rail system of claim 14, further comprising a first mounting member which is configured to be slidably inserted into and engaged with the accessory channel and secured therein by the first and second protrusions.

16. The door rail system of claim 15, further comprising a second mounting member which is configured to be slidably engaged with the first mounting member by a sliding dovetail joint so that the second mounting member can slide against the first mounting member.

17. The door rail system of claim 16, further comprising a location adjusting means for slidably adjusting a location of the second mounting member with respect to the first member.

18. The door rail system of claim 17, wherein the location adjusting means comprises an anchor and a screw wherein the anchor is fixedly attached to the first mounting member, wherein a through hole is formed on the anchor and a threaded hole is formed on the second mounting member such that the screw can pass through the through hole and be engaged with the threaded hole, wherein the location adjusting means adjusts the location of the second mounting member by rotating the screw.

19. A door rail system for mounting a pane, comprising an accessory channel having a first inner wall, a second inner wall and a base surface wherein a first protrusion is formed on the first inner wall and a second protrusion is formed on the second inner wall;

a first mounting member which is configured to be slidably inserted into and engaged with the accessory channel;

a second mounting member which is configured to be slidably engaged with the first mounting member by a sliding dovetail joint so that the second mounting member can slide in a longitudinal direction of the first mounting member wherein the pane is mounted on the second mounting member; and a location adjusting means for slidably adjusting a location of the second mounting member and the pane with respect to and along the first mounting member, wherein the first mounting member is secured in the accessory channel by the first and second protrusions, wherein the location adjusting means comprises an anchor and a screw wherein the anchor is fixedly attached to the first mounting member, wherein a through hole is formed on the anchor and a threaded hole is formed on the second mounting member such that the screw can pass through the through hole and be engaged with the threaded hole, wherein the location adjusting means adjusts the location of the second mounting member by rotating the screw.

* * * * *